US008146363B2

(12) United States Patent
Bellows

(10) Patent No.: US 8,146,363 B2
(45) Date of Patent: Apr. 3, 2012

(54) CONDENSER SYSTEM

(75) Inventor: James C. Bellows, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 498 days.

(21) Appl. No.: 12/366,763

(22) Filed: Feb. 6, 2009

(65) Prior Publication Data

US 2010/0199672 A1 Aug. 12, 2010

(51) Int. Cl.
*F01B 31/16* (2006.01)

(52) U.S. Cl. ..... 60/685; 60/686

(58) Field of Classification Search ..... 60/685–690
See application file for complete search history.

(56) References Cited

U.S. PATENT DOCUMENTS

| | | | | |
|---|---|---|---|---|
| 3,292,372 | A | 12/1966 | Michel | |
| 3,358,450 | A | 12/1967 | Schroedter et al. | |
| 3,660,980 | A * | 5/1972 | Knirsch et al. | 60/686 |
| 4,311,013 | A | 1/1982 | Kuribayashi et al. | |
| 4,518,035 | A | 5/1985 | Larinoff | |
| 4,584,836 | A | 4/1986 | McClelland | |
| 4,765,399 | A | 8/1988 | Haacker et al. | |
| 4,822,744 | A | 4/1989 | Bellows | |
| 5,095,706 | A | 3/1992 | Saito et al. | |
| 5,412,936 | A | 5/1995 | Lee et al. | |
| 5,473,898 | A | 12/1995 | Briesch | |
| 5,490,386 | A | 2/1996 | Keller et al. | |
| 5,507,145 | A | 4/1996 | Kurten et al. | |
| 5,766,320 | A | 6/1998 | Strock et al. | |
| 5,873,238 | A | 2/1999 | Bellows | |
| 6,588,499 | B1 * | 7/2003 | Fahlsing | 165/231 |
| 6,782,703 | B2 | 8/2004 | Dovali-Solis | |
| 6,872,308 | B1 | 3/2005 | Bellows | |
| 7,065,970 | B2 * | 6/2006 | Harpster | 60/685 |
| 7,306,653 | B2 | 12/2007 | Bellows et al. | |
| 2004/0003593 | A1 | 1/2004 | Sauer et al. | |

FOREIGN PATENT DOCUMENTS

| | | | |
|---|---|---|---|
| DE | 102005006137 | A1 | 8/2006 |
| JP | 59185987 | A | 10/1984 |
| JP | 11248372 | A | 9/1999 |

* cited by examiner

*Primary Examiner* — Hoang Nguyen

(57) ABSTRACT

A method of substantially preventing contaminants from entering a condenser adapted for use within a steam generating system. A condenser is provided. Steam or a combination of water and steam is passed into the condenser, the condenser operating in a normal mode if a pressure in a control area is equal to or greater than a predefined pressure and operating in a non-normal mode if the pressure in the control area is less than the predefined pressure. An inert gas is injected into the condenser if a pressure in the control area is less than a holding pressure, the holding pressure being equal to or greater than the predefined pressure.

20 Claims, 2 Drawing Sheets

CONDENSER SYSTEM

FIELD OF THE INVENTION

The present invention relates generally to a steam generating system and, more particularly, to a condenser system for use in a steam generating system that is maintained above a predefined pressure during both operating and non-operating modes.

BACKGROUND OF THE INVENTION

In steam generating systems, a condenser is used downstream of a steam turbine to convert steam, after it has passed through the steam turbine, from its gaseous state to its liquid state. The condenser may be air-cooled and comprises a steam inlet duct, a plurality of condenser tubes, and a condensate outlet duct. Steam passes into the condenser through the steam inlet duct and flows through the condenser tubes. Air is forced over outer surfaces of the tubes so as to cool the tubes and, hence, the steam flowing through the tubes, thus causing the steam to be converted into a liquid condensate. The condensate is reused in generating steam for the steam turbine such that at least a portion of it later returns to the condenser where it is once again converted to its liquid state in the condenser.

It is desirable to prevent contaminants, such as oxygen and carbon dioxide, from entering the condenser. When the concentrations of oxygen and carbon dioxide are high enough, they become corrodents to iron used in the condenser and other components of the steam generating system, including piping and a steam generator. The corrosion product is iron oxide which tends to deposit on the steam generator surfaces and reduce heat transfer. Corrosion also causes wall thinning of the condenser tubes and other steel structures, and can result in leaks and failures. In addition to being a corrodent, carbon dioxide interferes with monitoring of the steam generating system for more corrosive species, such as chloride. Hence, carbon dioxide is a nuisance that may require the steam generating system to use more sophisticated monitoring equipment at significantly greater expense.

The normal operating pressure in the condenser may be a few inches of mercury (absolute pressure) and, hence, the normal operating pressure is at a vacuum, i.e., less than 1 atmosphere absolute pressure. To prevent contaminants from entering the condenser after steam turbine shut-down, it is known to "break vacuum" with nitrogen instead of air. To "break vacuum" is to admit gas into the condenser in order to raise the pressure within the condenser from vacuum to a pressure substantially equal to 1 atmosphere. When nitrogen is used, the pressure is slightly above 1 atmosphere to be sure that leaks flow from the condenser to the outside. While this process reduces air ingress into the condenser after steam turbine shut-down, it is not completely effective because the condenser usually starts and operates below 1 atmosphere pressure and air leaks in while the condenser is below 1 atmosphere.

SUMMARY OF THE INVENTION

In accordance with one aspect of the present invention, a method of substantially preventing contaminants from entering a condenser adapted for use within a steam generating system is provided. A condenser is provided. Steam or a combination of water and steam is passed into the condenser, the condenser operating in a normal mode if a pressure in a control area is equal to or greater than a predefined pressure and in a non-normal mode if the pressure in the control area is less than the predefined pressure. An inert gas is injected into the condenser if a pressure in the control area is less than a holding pressure, the holding pressure being equal to or greater than the predefined pressure.

The control area may be located within the condenser.

The condenser may be in a non-normal operating mode if the condenser is receiving steam or a combination of water and steam at a supply rate less than that which is required to keep the pressure within the condenser equal to or above the predefined pressure.

The predefined pressure may be ambient pressure.

The condenser may be in a non-normal operating mode if the condenser is receiving zero steam or zero water and steam in combination.

The holding pressure may be equal to or greater than about 1.05 atmosphere.

The condenser may comprise a steam inlet duct and condenser tubes. Passing steam or a combination of water and steam into the condenser may comprise injecting steam or a combination of water and steam through the steam inlet duct which communicates with the condenser tubes.

A coolant fluid, which cooling fluid may be air, may be passed over outer surfaces of the condenser tubes.

At least one fan may be used to force the cooling fluid over the outer surfaces of the condenser tubes.

The inert gas may be nitrogen, argon, helium, or neon.

The control area may be located at an outlet of a steam operated device.

The condenser may be in a non-normal operating mode if a pressure in the control area is below a minimum required backpressure for the steam operated device outlet.

In accordance with another aspect of the present invention, a condenser system is provided adapted for use within a steam generating system. The condenser system comprises a condenser and a pressure maintenance apparatus. The condenser is adapted to receive steam or a combination of water and steam. The condenser is operating in a normal mode if a pressure in a control area is equal to or greater than a predefined pressure and in a non-normal mode if the pressure in the control area is less than the predefined pressure. The pressure maintenance apparatus causes an inert gas to flow into the condenser if the pressure in the control area is less than a holding pressure. The holding pressure is equal to or greater than the predefined pressure.

The pressure maintenance apparatus may comprise a first sensor for sensing the pressure in the control area and generating a pressure signal. The pressure maintenance apparatus may also comprise a controller coupled to the first sensor for receiving the pressure signal.

The predefined pressure may be ambient pressure.

The pressure maintenance apparatus may comprise a source of an inert fluid and valve apparatus associated with the fluid source and the controller. The controller opens the valve apparatus so as to allow the inert fluid from the fluid source to flow into the condenser when a pressure signal generated by the first pressure sensor indicates that a pressure in the control area is less than the holding pressure.

The controller may be in communication with a steam generating plant control system and may be capable of anticipating a pressure drop within a steam turbine in the steam generating system based on information from said steam generating plant control system. The controller may open the valve apparatus to allow a maximum amount of the inert fluid from the fluid source to flow into the condenser upon the controller anticipating a pressure drop within the steam turbine.

The control area may be located within the condenser.

The pressure maintenance apparatus may comprise a second sensor for sensing the pressure outside of the condenser. The predefined pressure may be defined by the outside pressure.

The control area may be located outside of the condenser.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
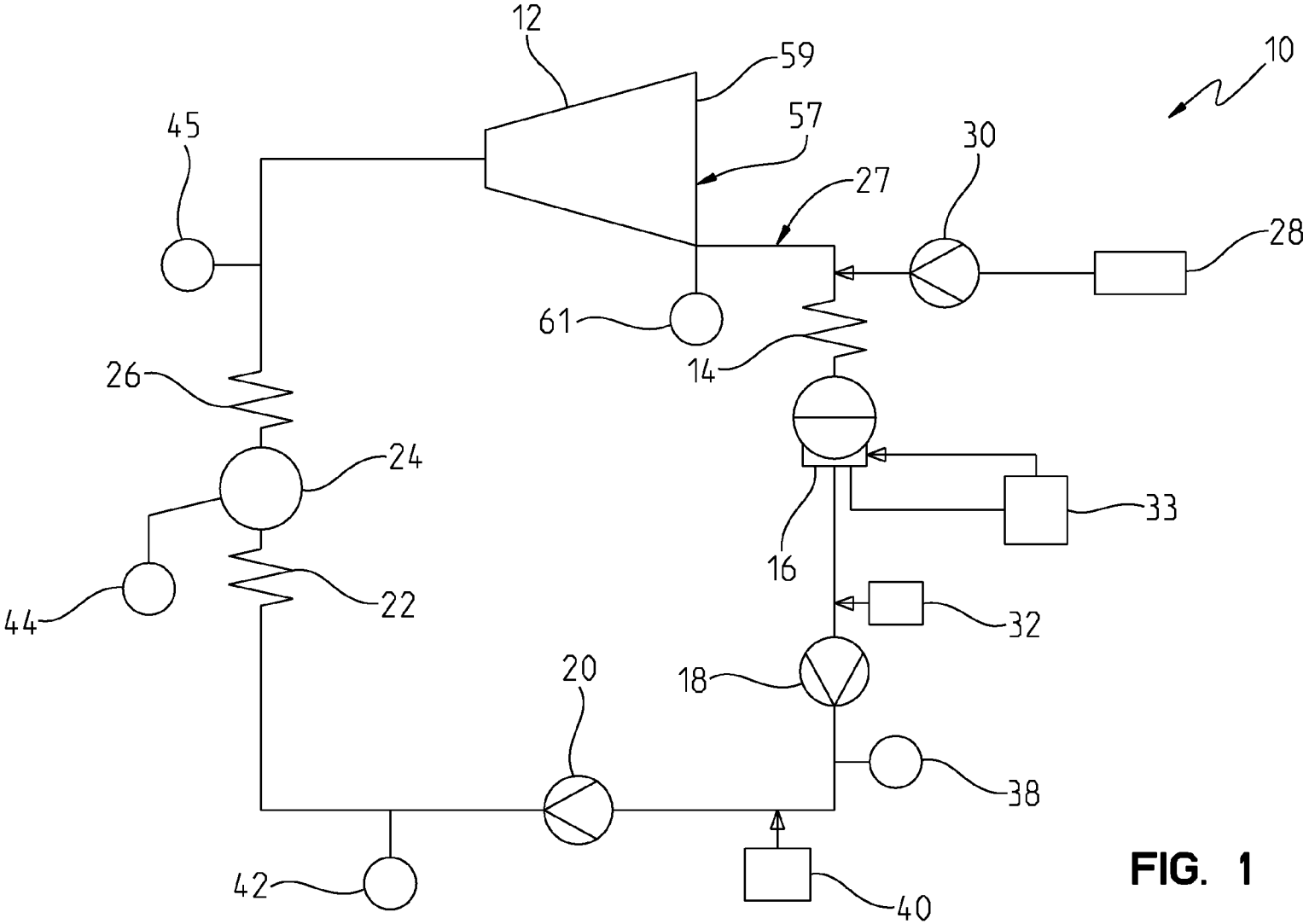
FIG. 1 is a diagrammatic illustration of a steam generating system in accordance with the invention.

Referring to FIG. 1, an exemplary steam generating system 10 constructed in accordance with an embodiment of the present invention is schematically shown. The steam generating system 10 comprises (moving clockwise in FIG. 1 starting from the top) a steam turbine 12, a condenser system 14, a condensate receiver tank 16, a first pump 18, a second pump 20, a condensate preheater or economizer 22, a drum 24 having an associated evaporator (not shown), and a super heater 26. The components are in fluid communication via conduits 27 that extend between adjacent components. As used herein, the term fluid may refer to any liquid, gas, or any combination thereof.

During operation, water and steam are cycled through the steam generating system 10 such that pressurized steam provided to the turbine 12 causes a rotor within the turbine 12 to rotate. Steam or a combination of water and steam exits the turbine 12 and is combined with an amount of make-up water from a demineralized water storage tank 28 so as to compensate for any water losses that may have occurred within the steam generating system 10. The make-up water is pumped by a third pump 30 into the steam or the combination of water and steam downstream from the turbine 12 or may be sprayed into a deaerator (not shown) associated with the condensate receiver tank 16 or into the condensate receiver tank 16. A configuration of the system 10 incorporating a deaerator is disclosed in U.S. patent application Ser. No. 12/366,802, entitled DEAERATOR APPARATUS IN A SUPERATMOSPHERIC CONDENSER SYSTEM, by James C. Bellows, filed concurrently with this patent application, the entire disclosure of which is incorporated herein by reference. The steam or combination of water and steam is then conveyed into the condenser system 14. In the condenser system 14, the enthalpy of the steam or combination of water and steam is lowered such that the steam or combination of water and steam is substantially converted into (liquid) condensate. The condensate then exits the condenser system 14 and flows into the condensate receiver tank 16, which may act as a collection tank for the condensate. After exiting the condensate receiver tank 16, oxygen may be provided to the condensate via an oxygen source 32 to promote a dense, protective hematite or magnetite passive layer on structure forming part of the steam generating system 10 in a process that will be apparent to those skilled in the art.

Optionally, a condensate polisher 33 may be included in the steam generating system 10. It is noted that the condensate polisher 33 may be temporarily utilized in the steam generating system 10 such that it is bypassed during normal operation of the steam generating system 10. The condensate polisher 33 may be used to remove contaminants from the condensate, such as upon start-up of the steam generating system 10. A configuration of the system 10 incorporating a condensate polisher is disclosed in U.S. patent application Ser. No. 12/366,738 entitled CONDENSATE POLISHER CIRCUIT, by James C. Bellows, filed concurrently with this patent application, the entire disclosure of which is incorporated herein by reference.

A condensate sample point 38 is located between the first and second pumps 18, 20 where the cation conductivity, oxygen, sodium, and silica of the condensate can be measured. Ammonia ($NH_3$) is then introduced into the condensate from a source of ammonia 40 located between the condensate sample point 38 and the second pump 20. The ammonia is introduced to raise the pH of the condensate, preferably to a pH of about 9. Once the ammonia is introduced into the condensate, the condensate is typically referred to as feed water, which feed water is sampled at a feed water sample point 42 and then fed into the economizer 22. At the feed water sample point 42, the specific conductivity, cation conductivity, pH, oxygen, sodium, iron, copper, and total organic carbon (TOC) of the feed water can be measured. If any of the measured properties are found to be out of specification, appropriate measures can be taken to correct the problem, as will be apparent to those skilled in the art.

The feed water is then fed into the economizer 22 where the feed water is heated to a few degrees below a saturation temperature defined by the steam generator pressure. For example, a 125 barg boiler would have a saturation temperature of 328° Celsius and a final feedwater temperature of about 325° Celsius. The heated feed water is then conveyed from the economizer 22 into the drum 24 wherein the feed water is typically referred to as drum water. A drum water sample point 44 is associated with the drum 24 where the cation conductivity, pH, sodium, silica, and iron of the drum water can be measured. If any of the measured properties are found to be out of specification, appropriate measures can be taken to correct the problem, as will be apparent to those skilled in the art. The drum water is cycled though the evaporator, which converts part of the drum water into steam. The mixture of steam and water rises to the top of the evaporator and into the drum 24 where the steam is separated from the water. The separated water returns to the evaporator and the steam passes into the super heater 26 wherein the temperature of the steam is increased to about 450 to 550° Celsius. The superheated steam is then sampled at a superheated steam sample point 45 where the cation conductivity, sodium, silica, and iron of the superheated steam may be measured. If any of the measured properties are found to be out of specification, appropriate measures can be taken to correct the problem, as will be apparent to those skilled in the art. The superheated steam is then conveyed into the steam turbine 12. As the superheated steam passes through the turbine 12, energy is removed from the steam and the steam exits the turbine 12 where it is again conveyed into the condenser system 14 for a subsequent cycle through steam generating system 10.

As will be discussed further below, the condenser system 14 comprises a condenser 140, see FIG. 2.

In accordance with a first embodiment of the present invention, during a normal operating mode of the condenser 140, a pressure in a first control area 50 located within the condenser 140 is equal to or greater than a predefined pressure. During a non-normal operating mode of the condenser 140, the pressure in the first control area 50 is less than the predefined pressure. In the illustrated embodiment, the predefined pressure is ambient pressure, which ambient pressure is typically 1 atmosphere (normal atmospheric pressure). If the predefined pressure is set below ambient, there is increased risk of contaminant leakage into the system. However, if a small amount of contamination is tolerable, allowing the system to be at slightly less than ambient pressure, e.g., between about 0.9 atm and about 1.0 atm, may be an economic advantage due to improved efficiency or simplicity of control. Hence, in such a case, the predefined pressure may be defined as being slightly less than ambient pressure.

Typically, in the illustrated embodiment, the amount of steam/water entering the condenser 140 from the conduit 27 is sufficient to maintain a pressure in the first control area 50 equal to or above ambient pressure. A non-normal operating mode of the condenser 140 may occur when the steam generating system 10 is shut down or the steam generating system 10 is operating at a reduced-load wherein a shut-down sequence has commenced but the steam generating system 10 has not completely shut-down. Hence, during a non-normal operating mode of the condenser 140, the amount of steam/water entering the condenser 140 from the conduit 27 may be reduced (i.e., during reduced-load operation) or null (i.e., during steam generating system shut down). Hence, the amount of steam/water entering the condenser 140 from the conduit 27 may not be sufficient to maintain pressure in the first control area 50 equal to or above the ambient pressure.

If the pressure in the first control area 50 falls below the ambient pressure, air or other contaminants, e.g., oxygen or carbon dioxide, may leak into the condenser 140, which is undesirable. The condenser 140 and other heat transfer components in the steam generating system 10 may be partially formed from iron, which may become corroded by high concentrations of oxygen and carbon dioxide. Specifically, a corrosion product, e.g., iron oxide, tends to deposit on the surfaces of the condenser system 14 and other heat transfer components in the steam generating system 10 that are formed at least partially from iron. The iron oxide is undesirable on the surfaces of these components as it reduces heat transfer. Further, corrosion may also cause wall thinning of condenser components and other structures within the steam generating system 10, which can result in leaks and failures.

Moreover, the carbon dioxide from the air may interfere with monitoring of the steam generating system 10. For example, carbon dioxide and chloride (a highly detrimental chemical species if leaked in the steam generating system 10) are both known to cause an increase in the cation conductivity of the steam/water flowing through the steam generating system 10. As the cation conductivity is measured at one or more of the sample points 38, 42, 44, 45 the high carbon dioxide may mask any indication for chloride in the steam generating system 10, i.e., the heightened cation conductivity due to high or increased chloride cannot be noticed due to the high cation conductivity caused by the carbon dioxide. Given that chloride is a highly detrimental species to have in the steam generating system 10, such masking of the chloride is very undesirable.

Figure 2:
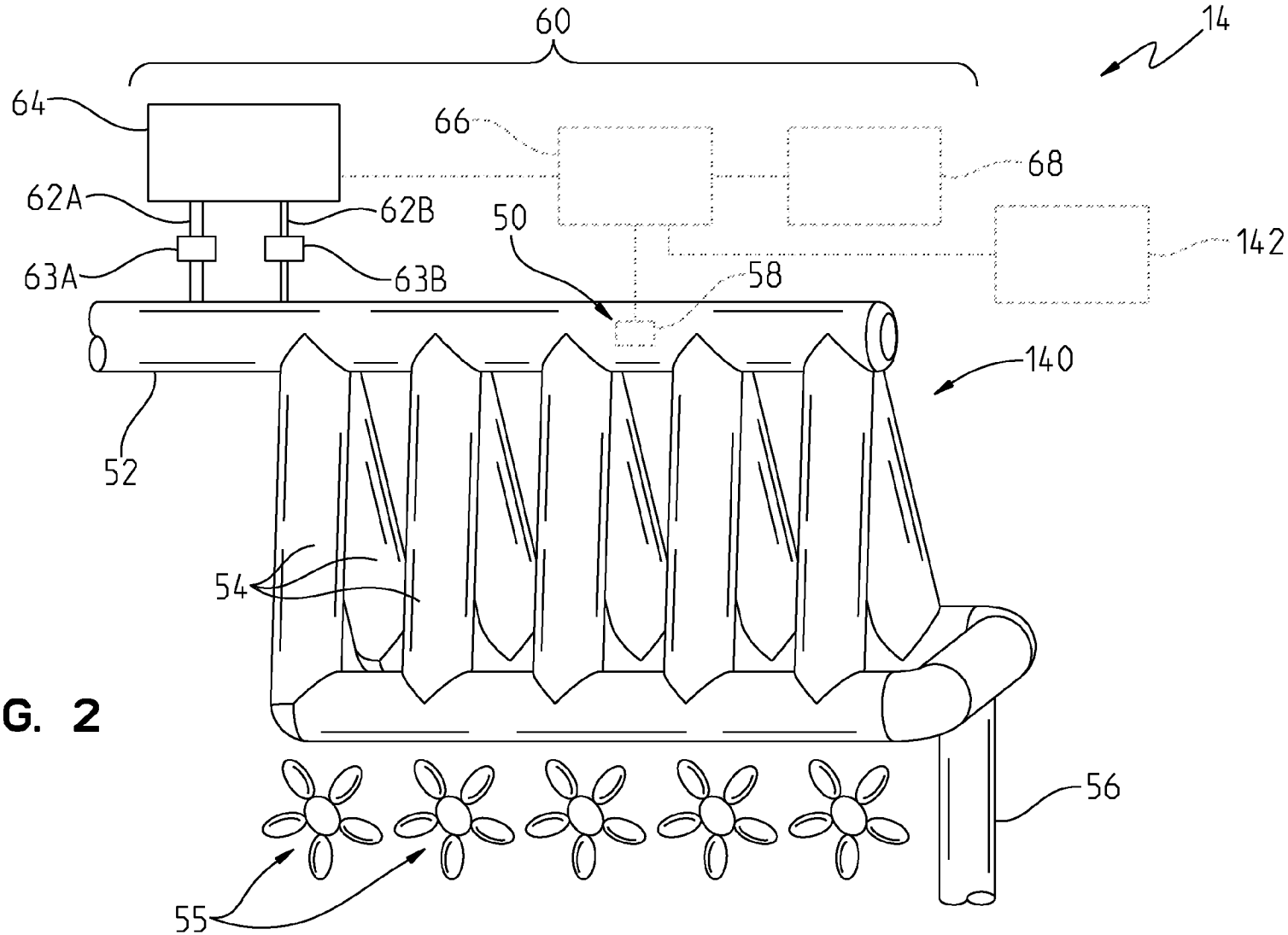
FIG. 2 is a front perspective view of the condenser illustrated in FIG. 1.

As noted above, the condenser system 14 comprises a condenser 140, see FIG. 2. The condenser 140, in the illustrated embodiment, comprises an air-cooled condenser, although other suitable types of condensers could be used. The condenser 140 comprises a steam inlet duct 52 and a plurality of condenser tubes 54 in fluid communication with the steam inlet duct 52. The steam inlet duct 52 is in fluid communication with a portion of the conduit 27 located between the steam turbine 12 and the condenser system 14 and conveys the steam or a combination of water and steam from the turbine 12 into the condenser tubes 54. It is noted that the configuration of the condenser 140 illustrated in FIG. 2 is exemplary and a working condenser according to other embodiments of the invention may differ from the condenser 140 shown. For example, the number, construction, and spacing of the condenser tubes 54 may be different than as shown in FIG. 2.

The condenser tubes 54 are cooled by air that flows across outer surfaces of the tubes 54. Air may be forced over the condenser tubes 54 by one or more fans 55. It is noted that the condenser tubes 54 may be cooled by other means, for example, where the condenser tubes 54 are submerged in an oil or pressurized water bath (not shown). The condenser tubes 54 may be formed from any suitable material, for example, steel, for defining a path for energy in the form of heat to transfer from the steam or a combination of water and steam flowing through the tubes 54 to the air forced across the outer surfaces of the tubes 54. The condenser tubes 54 may include one or more heat exchanger fins (not shown) associated therewith for improving the heat transfer between the steam or a combination of water and steam flowing through the condenser tubes 54 and the cooling air. As the steam or a combination of water and steam is cooled it is converted into (liquid) condensate. Once condensed, the condensate flows toward the bottom of the condenser tubes 54 and exits the condenser 140 through a condensate outlet duct 56, which condensate outlet duct 56 conveys the condensate into the condensate receiver tank 16.

As noted above, during a normal operating mode of the condenser 140, the amount of steam or a combination of water and steam entering the condenser 140 from the conduit 27 is sufficient to maintain the pressure in the first control area 50, i.e., within the condenser 140, equal to or above the predefined pressure, which, as noted above, may be ambient pressure. However, during non-normal operating modes, the amount of steam or a combination of water and steam entering the condenser 140 through the conduit 27 may not be sufficient to maintain the pressure in the first control area 50 equal to or above the predefined pressure.

In the illustrated embodiment, the condenser system 14 further comprises a pressure maintenance apparatus 60. The pressure maintenance apparatus 60 may maintain the pressure in the first control area 50 at a level equal to or greater than the predefined pressure during both normal and non-normal operating modes so as to prevent air from leaking into the condenser 140 at any time when the predefined pressure is equal to or greater than ambient pressure. If the predefined pressure is slightly below ambient pressure, it is believed that only a very small amount of air will leak into the condenser 140.

In the illustrated embodiment, the pressure maintenance apparatus 60 comprises a first conduit 62A having an associated first valve 63A, such as, for example, a block valve (includes only on and off positions). The first conduit 62A is in fluid communication with a fluid source 64 and also with the steam inlet duct 52. The fluid within the source 64 may be any suitable fluid, but in a preferred embodiment comprises an inert gas, such as, for example, nitrogen, helium, argon, or neon, or a combination of two or more of these gases, and in a most preferred embodiment comprises gaseous nitrogen. Optionally, a second fluid conduit 62B may be provided having an associated second valve 63B, such as, for example, a continuously variable position valve for providing a regulated, variable flow of the fluid through the second fluid conduit 62B. The second conduit 62B is in fluid communication with the fluid source 64 and also with the steam inlet duct 52 and may provide fine-tuned delivery of the fluid from the fluid source 64.

The pressure maintenance apparatus 60 further comprises a first pressure sensor 58 located in the first control area 50 within the condenser 140 and a control unit or controller 66. The first pressure sensor 58 senses the pressure in the first control area 50 and generates a corresponding pressure signal to the control unit 66, which control unit 66 may be located remotely from the condenser 140. The control unit 66 is in communication with and controls the operation of the first and second valves 63A, 63B in response to the pressure signal received from the sensor 58 so as to control fluid flow from the fluid source 64 through the first and second conduits 62A, 62B and first and second valves 63A, 63B into the condenser 140.

When the pressure in the first control area 50, as sensed by the first pressure sensor 58, falls below a holding pressure, the control unit 66 controls the first and second valves 63A, 63B to deliver the fluid from the fluid source 64 into the condenser system 14. In the illustrated embodiment, the holding pressure is a pressure slightly higher than the predefined pressure, which predefined pressure, as noted above, is ambient pressure in the illustrated embodiment. Ambient pressure is presumed to equal 1 atmosphere in the illustrated embodiment. Hence, the holding pressure may equal 1.05 atmosphere (atm). Thus, the leakage of air and other contaminants from outside the condenser 140 into the condenser 140 is substantially prevented. Specifically, due to the pressure differential between the pressure within the condenser 140 versus the ambient pressure, any leakage would be from inside of the condenser 140 to outside of the condenser 140. It is also contemplated that the holding pressure may equal the predefined pressure or any value greater than the predefined pressure.

Optionally, a second pressure sensor 68 may be provided to monitor the pressure on the outside of the condenser 140. The second pressure sensor 68 is in communication with the control unit 66. The control unit 66 compares the pressure in the first control area 50, as measured by the first pressure sensor 58, to the pressure outside of the condenser 140, as measured by the second pressure sensor 68. The second pressure sensor 68 may be beneficial, for example, when a non-air-cooled condenser is used, such as when the condenser is submerged in an oil or pressurized water bath as referenced above. In such a case, the second pressure sensor 68 measures the pressure of the oil defining the oil bath or the pressurized water defining the pressurized water bath. The predefined pressure is equal to the pressure acting on an outer surface of the condenser 140, which is equal to the oil or pressurized water pressure sensed by sensor 68. Hence, the holding pressure may be a pressure equal to or slightly higher than the predefined pressure, which predefined pressure, is again equal to the pressure acting on the outer surface of the condenser 140 by the oil or pressurized water and is sensed by the second sensor 68. The holding pressure may vary with the predefined pressure. When the pressure in the first control area 50, which pressure is sensed by the first pressure sensor 58, falls below the holding pressure, which holding pressure is equal to or slightly higher than the predefined pressure measured by the second pressure sensor 68, the control unit 66 controls the first and second valves 63A, 63B to deliver the inert fluid into the condenser system 14.

When the pressure in the first control area 50 is less than the holding pressure, inert fluid is delivered into the condenser 140 until the pressure in the first control area 50 is equal to or greater than a ceiling pressure, which is preferably slightly greater than the predefined holding pressure. In a preferred embodiment, the inert fluid delivered from the fluid source 64 into the condenser 140 is at a pressure less than or equal to the ceiling pressure such that the inert fluid cannot raise the pressure in the first control area 50 above the ceiling pressure. Hence, in the event that the steam generating system 10 is maintained in a shut-down mode for a prolonged period of time, in which case very little or no steam/water will be provided into the condenser 140, the inert fluid can be delivered into the condenser system 14 continuously without interruption and without raising the pressure in the first control area 50 above the ceiling pressure. Such an arrangement may improve the efficiency of inert gas use by the pressure maintenance apparatus 60.

The ceiling pressure is preferably sufficiently low enough so as to limit waste of the inert fluid, i.e., by delivering an unnecessarily high amount of inert fluid into the condenser 140. In other words, the holding pressure is sufficiently above the pressure on the outside of the condenser 140 to substantially prevent contaminants from entering the condenser 140, while the ceiling pressure is high enough to prevent the pressure maintenance apparatus 60 from being triggered on and off too frequently while being low enough so as to reduce waste of the inert fluid. It is understood that the predetermined holding and ceiling pressures and the amount of inert fluid provided to the condenser 140 can vary depending on the size and particular arrangement of the condenser 140 and the steam generating system 10.

It is noted that a pressure relief valve (not shown) may be associated with the condenser 140 to maintain the pressure within the condenser 140 under the ceiling pressure, i.e., the pressure relief valve may be configured to open and therefore release pressure from the condenser 140 if the pressure within the condenser 140 reaches the ceiling pressure.

The pressure maintenance apparatus 60 substantially prevents air and other contaminants from entering the condenser 140 during normal and non-normal operating modes of the condenser 140 by maintaining the pressure in the first control area 50, i.e., within the condenser 140, equal to or above the pressure on the outside of the condenser 140. Accordingly, damage to the components of the steam generating system 10 associated with corrodents resulting from the air, and also the monitoring problems described above associated with the carbon dioxide in the air, are substantially avoided.

Under certain circumstances it may be desirable to inject the inert fluid into the condenser 140 at a maximum flow rate. For example, the controller 66 may be in communication with a steam generating plant control system 142, see FIG. 2. Based on information from the steam generating plant control system 142, the controller 66 is capable of anticipating a significant pressure drop, e.g., such as during a turbine trip as might result when the steam supply to the steam turbine 12 is abruptly terminated. In the case of an anticipated significant pressure drop, the controller 66 may immediately open the first and or second valves 63A, 63B such that a desired amount, e.g., a maximum amount, of the inert fluid may flow through the first and second conduits 62A, 62B and first and second valves 63A, 63B into the condenser 140. The desired amount of fluid injected into the condenser 140 may temporarily cause the pressure within the condenser 140 to approach the ceiling pressure, but once any steam within the condenser 140 is condensed, the pressure may drop back to the predefined pressure.

The pressure maintenance apparatus 60 may also provide other types of benefits in steam generating systems. For example, steam generating systems may include a steam operated device, such as a steam turbine, which may have a backpressure requirement, i.e., wherein a last turbine stage is required to discharge to a pressure in a particular range, and the range may start above zero pressure absolute, e.g., from about 1.5 atmosphere absolute pressure to about 2.0 atmosphere absolute pressure. In such a system and in accordance with a second embodiment of the present invention, a pressure may be measured with a pressure sensor 61 located in a second control area 57 at a steam turbine outlet 59 (see FIG. 1).

A controlled injection of a fluid, i.e., nitrogen, into a condenser of such a steam generating system can be used to control condenser pressure and thereby control the upstream pressure in the second control area 57. It is noted that the pressure in the second control area 57 may be substantially equal to the pressure in the condenser 140, i.e., if a conduit between the steam turbine outlet 59 and the condenser 140 is relatively short and has a relatively large diameter. A controller may control the injection of the nitrogen into the condenser 140 to maintain the pressure in the second control area 57 equal to or greater than a desired backpressure via the condenser pressure. In this case, the desired backpressure in the second control area 57 may be equal to or greater than the minimum backpressure requirement at the steam turbine outlet 59, e.g., 1.5 atmosphere absolute pressure.

Following this example, a predefined pressure in the second control area 57 may be selected so as to be equal to or greater than the desired backpressure. Hence, the pressure in the second control area 57, i.e., at the steam turbine outlet 59, is maintained at a level substantially equal to or greater than the desired backpressure of the steam turbine outlet 59, which, as noted above, is equal to or greater than the minimum backpressure requirement of the steam turbine outlet 59.

Further, a holding pressure in the second control area 57 may be defined to be equal to or slightly higher than the predefined pressure, so as to maintain the pressure in the second control area 57, i.e., at the steam turbine outlet 59, equal to or slightly above the predefined pressure. Hence, when the pressure in the second control area 57 falls below the holding pressure, the controller causes a fluid, such as nitrogen, to be delivered into the condenser system 14. In the case of this example, a non-normal operating mode of the condenser 140 occurs when a pressure in the second control area 57, as measured by the pressure sensor 61, which may equal the pressure within the condenser 140, is below the predefined pressure which, as noted above, is equal to or greater than the desired backpressure at the steam turbine outlet 59.

It is noted that the nitrogen tends to reduce heat transfer to the steam in the condenser 140 by forming a nitrogen film against or on inner surfaces of the condenser tubes 54. For example, the nitrogen film inhibits the steam from directly contacting the heat transfer surfaces of the condenser tubes 54, thus slowing condensation of the steam. The slowed condensation increases the partial pressure of the steam, thus elevating the pressure within the condenser 140. The partial pressure of the nitrogen also elevates the pressure in the condenser 140 somewhat.

It is also noted that variable speed fans can also reduce the heat transfer and thus slow the condensing of the steam to raise the pressure within the condenser 140, and may be more desirable. However, variable speed fans must be selected at construction and may not be present in a given steam generating system. Since the nitrogen supply of the pressure maintenance apparatus 60 is already present for substantially preventing air and other contaminants from entering the condenser 140 during non-operating modes of the condenser 140, using the nitrogen injection in a controlled way may provide the same benefit as the variable speed fans without the extra construction expense. This is an economic trade-off that depends on the frequency of need for variable speed fans.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of substantially preventing contaminants from entering a condenser adapted for use within a steam generating system, the method comprising:

providing a condenser;

passing steam or a combination of water and steam into the condenser, the condenser operating in a normal mode if a pressure in a control area is equal to or greater than a predefined pressure and in a non-normal mode if the pressure in the control area is less than the predefined pressure;

monitoring the pressure within the control area to determine if the pressure within the control area drops below a holding pressure, the holding pressure being equal to or greater than the predefined pressure; and injecting an inert gas into the condenser if the monitored pressure in the control area is less than the holding pressure.

2. The method as set out in claim 1, wherein the control area is located within the condenser.

3. The method as set out in claim 2, wherein the condenser is in a non-normal operating mode if the condenser is receiving steam or a combination of water and steam at a supply rate less than that which is required to keep the pressure within the condenser equal to or above said predefined pressure.

4. The method as set out in claim 3, wherein the predefined pressure is ambient pressure.

5. The method as set out in claim 2, wherein the condenser is in a non-normal operating mode if the condenser is receiving zero steam or zero water and steam in combination.

6. The method as set out in claim 2, wherein the holding pressure is equal to or greater than about 1.05 atmosphere.

7. The method as set out in claim 1, wherein the condenser comprises a steam inlet duct and condenser tubes and passing steam or a combination of water and steam into the condenser comprises injecting steam or a combination of water and steam through the steam inlet duct which communicates with the condenser tubes.

8. The method as set out in claim 7, further comprising passing a coolant fluid over outer surfaces of the condenser tubes.

9. The method as set out in claim 8, wherein the coolant fluid passing over the outer surfaces of the condenser tubes comprises air and wherein passing a coolant fluid over outer surfaces of the condenser tubes comprises using at least one fan to force the cooling fluid over the outer surfaces of the condenser tubes.

10. The method as set out in claim 1, wherein the inert gas is one of nitrogen, argon, helium, and neon.

11. The method as set out in claim 1, wherein the control area is located at an outlet of a steam operated device.

12. The method as set out in claim 11, wherein the condenser is in a non-normal operating mode if a pressure in the control area is below a minimum required backpressure for the steam operated device outlet.

13. A condenser system adapted for use within a steam generating system comprising:

a condenser adapted to receive steam or a combination of water and steam, the condenser operating in a normal mode if a pressure in a control area is equal to or greater than a predefined pressure and in a non-normal mode if the pressure in the control area is less than the predefined pressure; and pressure maintenance apparatus for sensing a pressure in the control area and causing an inert gas to flow into the condenser if the pressure in the control area is less than a holding pressure, the holding pressure being equal to or greater than said predefined pressure.

14. The condenser system as set out in claim 13, wherein said pressure maintenance apparatus comprises a first sensor for sensing the pressure in the control area and generating a pressure signal, and a controller coupled to said first sensor for receiving said pressure signal.

15. The condenser system as set out in claim 14, wherein the predefined pressure is ambient pressure.

16. The condenser system as set out in claim 14, wherein said pressure maintenance apparatus further comprises:

a fluid source containing an inert gas; and valve apparatus associated with said fluid source and said controller, said controller opening said valve apparatus so as to allow the inert gas from said fluid source to flow directly into said condenser when a pressure signal generated by said first pressure sensor indicates that a pressure in said control area is less than the holding pressure.

17. The condenser system as set out in claim 16, wherein said controller is in communication with a steam generating plant control system and is capable of anticipating a pressure drop within a steam turbine in the steam generating system based on information from said steam generating plant control system, said controller opening said valve apparatus to allow a maximum amount of said inert fluid from said fluid source to flow into said condenser upon said controller anticipating a pressure drop within the steam turbine.

18. The condenser system as set out in claim 14, wherein said control area is located within said condenser.

19. The condenser system as set out in claim 18, wherein said pressure maintenance apparatus further comprises a second sensor for sensing the pressure outside of said condenser, said predefined pressure being defined by said outside pressure.

20. The condenser system as set out in claim 13, wherein said control area is located outside of said condenser.

* * * * *